US005554096A

United States Patent [19]

Ball

[11] Patent Number: 5,554,096

[45] Date of Patent: Sep. 10, 1996

[54] IMPLANTABLE ELECTROMAGNETIC HEARING TRANSDUCER

[75] Inventor: Geoffrey R. Ball, Sunnyvale, Calif.

[73] Assignee: Symphonix, San Jose, Calif.

[21] Appl. No.: 225,153

[22] Filed: Apr. 8, 1994

Related U.S. Application Data

[63] Continuation-in-part of Ser. No. 87,618, Jul. 1, 1993, Pat. No. 5,456,654.

[51] Int. Cl.[6] ..... H04R 25/00

[52] U.S. Cl. ..... 600/25; 607/57; 381/69

[58] Field of Search ..... 600/25; 607/55–57; 381/68–68.4

[56] References Cited

U.S. PATENT DOCUMENTS

| | | | |
|---|---|---|---|
| 3,594,514 | 7/1971 | Wingrove | 600/25 |
| 3,712,962 | 1/1973 | Epley | 600/25 |

(List continued on next page.)

FOREIGN PATENT DOCUMENTS

| | | | |
|---|---|---|---|
| 1440724 | 6/1976 | United Kingdom | 179/107 E |

OTHER PUBLICATIONS

J. Hough et al., "A Middle Ear Implantable Hearing Device for Controlled Amplification of Sound in the Human: A Preliminary Report," Laryngoscope, 97:141–51 (1987).

N. Yanagihara et al., "Development of an Implantable Hearing Aid Using a Piezoelectric Vibrator of Bimorph Design: State of the Art," Otolaryngol Head Neck Surg, 92:706 (1984).

J. Heide et al., "Development of a Semi–Implantable Hearing Device," Adv Audiol, 4:32–43 (1988).

A. J. Maniglia et al., "Design, Development, and Analysis of a Newer Electro–Magnetic Semi–Implantable Ear Hearing Device," Transplants and Implants in Otology II, pp. 365–369 (1992).

E. Lenkauskas, "Otally Implantable Hearing Aid Device," Transplants and Implants in Otology II, pp. 371–375 (1992).

J–I Suzuki et al., "Further Clinical Experiences with Middle–Ear Implantable Hearing Aids: Indications and Sound Quality Evaluation," ORL J Otorhinolaryngol Relat Spec, 51:229–234 (1989).

R. L. Goode, "Current Status of Electromagnetic Implantable Hearing Aids," Otolaryngologic Clinics of North America, 22:201–09 (1989).

S. C. Parisier et al., "Cochlear Implants: Indications and Technology," Medical Clinics of North America, 75:1267–76 (1991).

R. L. Goode, "Implantable Hearing Devices," Medical Clinics of North America, 75:1261–66 (1991).

B. A. Weber et al., "Application of an Implantable Bone Conduction Hearing Device to Patients with Unilateral Sensorineural Hearing Loss," Laryngoscope, 102:538–42 (1992).

E. Buchman et al., "On the Transmission of Sound Generated by an Electromagnetic Device from the Mastoid Process to the Petrous Bone," J Acoust Soc Am, 90:895–903 (1991).

(List continued on next page.)

*Primary Examiner*—Angela D. Sykes
*Assistant Examiner*—John P. Lacyk
*Attorney, Agent, or Firm*—Medlen & Carroll

[57] ABSTRACT

An electromagnetic transducer for improving hearing in a hearing impaired person comprises a magnet assembly and a coil secured inside a housing which is fixed to an ossicle of a middle ear. The coil is more rigidly secured to the housing than the magnet. The magnet assembly and coil are configured such that conducting alternating electrical current through the coil creates magnetic field thereby causing the magnet assembly and coil to vibrate relative to one another. Because the coil is more rigidly secured to the housing than the magnet assembly, the vibrations of the coil cause the housing to vibrate. The vibrations are conducted to the oval window of the ear via the ossicles. In alternate embodiments, the transducer is secured to ossicular prostheses that are secured within the middle ear.

12 Claims, 16 Drawing Sheets

U.S. PATENT DOCUMENTS

| | | | |
|---|---|---|---|
| 3,870,832 | 3/1975 | Fredrickson | 179/107 E |
| 3,882,285 | 5/1975 | Nunley et al. | 179/107 E |
| 4,063,048 | 12/1977 | Kissaih, Jr. | 179/107 R |
| 4,063,049 | 12/1977 | Pipitone et al. | 179/110 A |
| 4,606,329 | 8/1986 | Hough | 128/1 R |
| 4,611,598 | 9/1986 | Hortmann et al. | 128/419 R |
| 4,612,915 | 9/1986 | Hough et al. | 128/1 R |
| 4,728,327 | 3/1988 | Gersdorff | 623/10 |
| 4,776,322 | 10/1988 | Hough et al. | 128/1.6 |
| 4,800,884 | 1/1989 | Heide et al. | 128/419 R |
| 4,817,607 | 4/1989 | Tatge | 128/419 R |
| 4,817,609 | 4/1989 | Perkins et al. | 128/420.6 |
| 4,936,306 | 6/1990 | Ashtiani et al. | 128/420.6 |
| 4,969,900 | 11/1990 | Fleischer | 623/10 |
| 4,988,333 | 1/1991 | Engebretson et al. | 600/25 |
| 5,015,224 | 5/1991 | Maniglia | 600/25 |
| 5,015,225 | 5/1991 | Hough et al. | 600/25 |
| 5,085,628 | 2/1992 | Engebretson et al. | 600/25 |
| 5,257,623 | 11/1993 | Karasev et al. | 607/27 |
| 5,259,032 | 11/1993 | Perkins et al. | 381/68 |
| 5,259,033 | 11/1993 | Goodings et al. | 381/68 |
| 5,277,694 | 1/1994 | Leysieffer et al. | 600/25 |

OTHER PUBLICATIONS

B. Häkansson et al., "Percutaneous vs. Transcutaneous Transducers for Hearing Direct Bone Condition," Otolaryngol Head Neck Surg, 102:339 (1990).

T. M. McGee et al., "Electromagnetic Semi–Implantable Hearing Device: Phase I. Clinical Trials," Laryngoscope, 101:355 (1991).

J. M. Kartush et al., "Electromagnetic Semi–Implantable Hearing Device: An Update," Otolaryngol Head Neck Surg. 104:150 (1991).

A. Baumfield et al., "Performance of Assistive Listening Devices Using Insertion Gain Measures," Scand Audiol, 22:43–46 (1993).

IMPLANTABLE ELECTROMAGNETIC HEARING TRANSDUCER

RELATED APPLICATION DATA

This application is a Continuation-In-Part Application of application Ser. No. 08/087,618 filed on Jul. 1, 1993 now U.S. Pat. No. 5,456,654.

FIELD OF THE INVENTION

The present invention relates to the field of devices and methods for improving hearing in hearing impaired persons and particularly to the field of implantable transducers for vibrating the bones of the middle ear.

BACKGROUND OF THE INVENTION

A number of auditory system defects are known to impair or prevent hearing. To illustrate such defects, a schematic representation of part of the human auditory system is shown in FIG. 9. The auditory system is generally comprised of an external ear AA, a middle ear JJ, and an internal ear FF. The external ear AA includes the auditory canal BB and the tympanic membrane CC, and the internal ear FF includes an oval window EE and a vestibule GG which is a passageway to the cochlea (not shown). The middle ear JJ is positioned between the external ear and the inner ear, and includes an eustachian tube KK and three bones called ossicles DD. The three ossicles DD, the malleus LL, the incus MM, and the stapes HH, are positioned between and connected to the tympanic membrane CC and the oval window EE.

In a person with normal hearing, sound enters the external ear AA where it is slightly amplified by the resonant characteristics of the auditory canal BB of the external ear. The sound waves produce vibrations in the tympanic membrane CC, part of the external ear that is positioned at the proximal end of the auditory canal BB. The force of these vibrations is magnified by the ossicles DD.

Upon vibration of the ossicles DD, the oval window EE, which is part of the internal ear FF, conducts the vibrations to cochlear fluid (not shown) in the inner ear FF thereby stimulating receptor cells (not shown), or hairs, within the cochlea. In response to the stimulation, the hairs generate an electrochemical signal which is delivered to the brain via one of the cranial nerves and which causes the brain to perceive sound.

Some patients with hearing loss have ossicles that lack the resiliency necessary to increase the force of vibrations to a level that will adequately stimulate the receptor cells in the cochlea. Other patients have ossicles that are broken, and which therefore do not conduct sound vibrations to the oval window.

Prostheses for ossicular reconstruction are sometimes implanted in patients who have partially or completely broken ossicles. These prostheses are normally cut to fit snugly between the tympanic membrane CC and the oval window EE or stapes HH. The close fit holds the implants in place, although gelfoam is sometimes packed into the middle ear to ensure against loosening. Two basic forms are available: total ossicle replacement prostheses (TORPs), which are connected between the tympanic membrane CC and the oval window EE; and partial ossicle replacement prostheses (PORPs), which are positioned between the tympanic membrane and the stapes HH.

Although these prostheses provide a mechanism by which vibrations may be conducted through the middle ear to the oval window of the inner ear, additional devices are frequently necessary to ensure that vibrations are delivered to the inner ear with sufficient force to produce high quality sound perception. Even when a prosthesis is not used, disease and the like can result in hearing impairment.

Various types of hearing aids have been developed to restore or improve hearing for the hearing impaired. With conventional hearing aids, sound is detected by a microphone, amplified using amplification circuitry, and transmitted in the form of acoustical energy by a speaker or transducer into the middle ear by way of the tympanic membrane. Often the acoustical energy delivered by the speaker is detected by the microphone, causing a high-pitched feedback whistle. Moreover, the amplified sound produced by conventional hearing aids normally includes a significant amount of distortion.

Attempts have been made to eliminate the feedback and distortion problems associated with conventional hearing aid systems. These attempts have yielded devices which convert sound waves into electromagnetic fields having the same frequencies as the sound waves. A microphone detects the sound waves, which are both amplified and converted to an electrical current. The current is delivered to a coil winding to generate an electromagnetic field which interacts with the magnetic field of a magnet positioned in the middle ear. The magnet vibrates in response to the interaction of the magnetic fields, causing vibration of the bones of the middle ear or the skull.

Existing electromagnetic transducers present several problems. Many are installed using complex surgical procedures which present the usual risks associated with major surgery and which also require disarticulating (disconnecting) one or more of the bones of the middle ear. Disarticulation deprives the patient of any residual hearing he or she may have had prior to surgery, placing the patient in a worsened position if the implanted device is later found ineffective in improving the patient's hearing.

Existing devices also are incapable of producing vibrations in the middle ear which are substantially linear in relation to the current being conducted to the coil. Thus the sound produced by these devices includes significant distortion because the vibrations conducted to the inner ear do not precisely correspond to the sound waves detected by the microphone.

An easily implantable electromagnetic transducer is therefore needed which will conduct vibrations to the oval window with sufficient force to stimulate hearing perception and with minimal distortion.

SUMMARY OF THE INVENTION

The present invention relates to the field of devices and methods for improving hearing in hearing impaired persons and particularly to the field of implantable transducers for vibrating the bones of the middle ear. In one embodiment, the implantable electromagnetic transducer of the present invention includes a magnet positioned inside a housing that is proportioned to be disposed in the ear and in contact with middle ear or internal ear structure such as the ossicles or the oval window. A coil is also disposed inside the housing. The coil and magnet are each connected to the housing, and the coil is more rigidly connected to the housing than the magnet.

When alternating current is delivered to the coil, the magnetic field generated by the coil interacts with the magnetic field of the magnet causing both the magnet and the coil to vibrate. As the current alternates, the magnet and the coil and housing alternately move towards and away from each other.

The vibrations produce actual side-to-side displacement of the housing and thereby vibrate the structure in the ear to which the housing is connected.

GENERAL DESCRIPTION OF THE INVENTION

Figure 1:
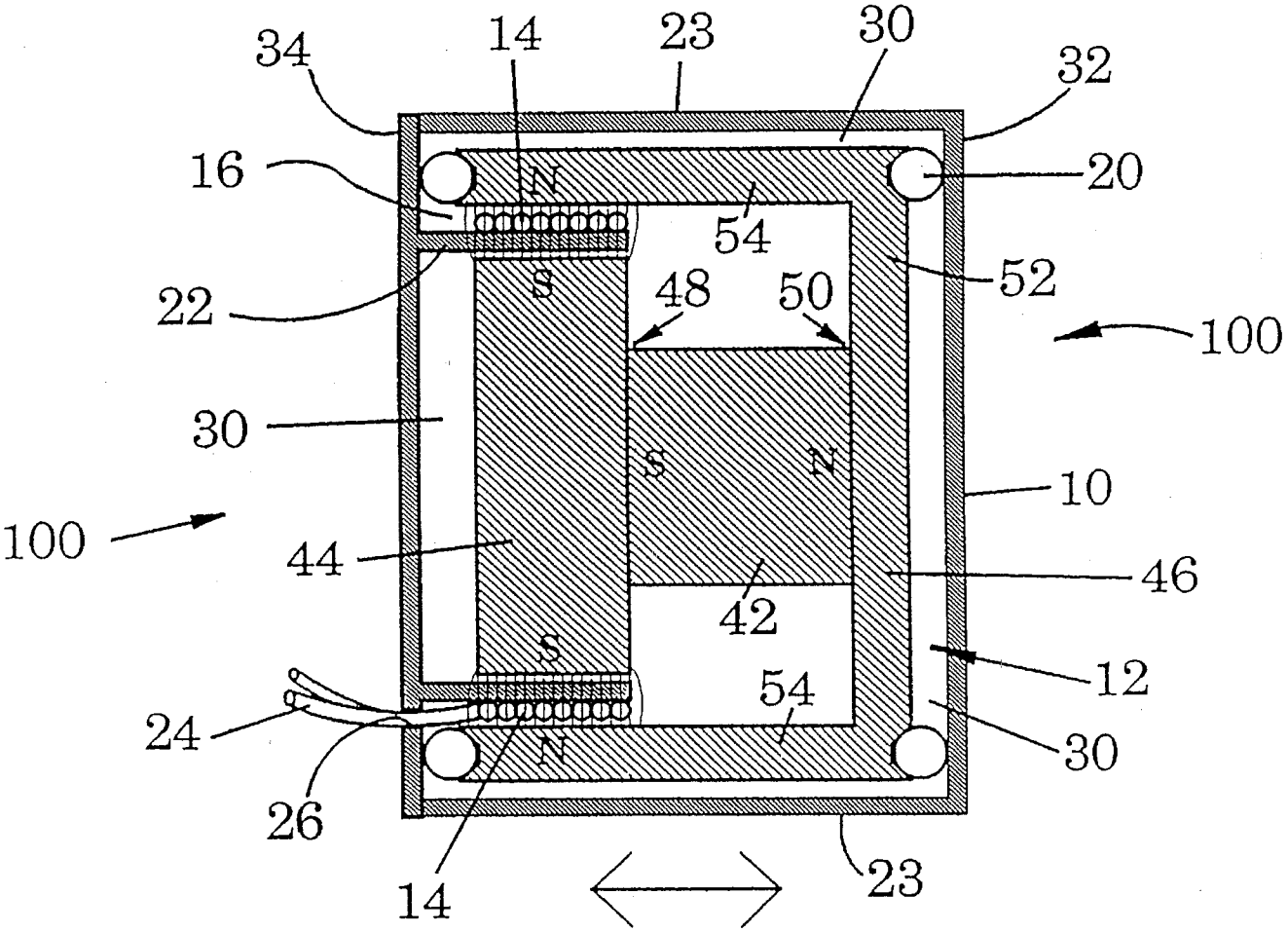
FIG. 1 is a cross-sectional side view of a transducer according to the present invention.

The present invention relates to the field of devices and methods for improving hearing in hearing impaired persons and particularly to the field of implantable transducers for vibrating the bones of the middle ear. To employ the devices and methods of the present invention with the greatest success, it is necessary to understand: i) the characteristics of the electromagnetic transducer itself and the mechanism of its function; ii) the process of selecting hearing-impaired patients most likely to benefit from the implantation of the transducer; iii) the surgical procedure used to implant the transducer into the middle ear; and iv) post-operative treatment and other procedures. Each of these points is described below in the following order: I) The Electromagnetic Transducer; II) Pre-Operative Procedure; III) Surgical Procedure; and IV) Post-Operative Procedure.

I. THE ELECTROMAGNETIC TRANSDUCER

The invention includes an electromagnetic transducer comprised of a magnet assembly and a coil secured inside a sealed housing. The housing is proportioned to be affixed to an ossicle within the middle ear. While the present invention is not limited by the shape of the housing, it is preferred that the housing is of a cylindrical capsule shape. Similarly, it is not intended that the invention be limited by the composition of the housing. In general, it is preferred that the housing be composed of a biocompatible material.

The housing contains both the coil and the magnet assembly. The magnet assembly is positioned in such a manner that it can oscillate freely without colliding with either the coil or the interior of the housing itself. When properly positioned, a permanent magnet within the assembly produces a predominantly uniform flux field. Although the preferred embodiment of the invention involves use of permanent magnets, electromagnets may also be used.

Various components are involved in delivering the signal derived from externally-generated sound to the coil affixed within the middle ear housing. First, an external sound transducer similar to a conventional hearing aid transducer is positioned on the skull. This external transducer processes the sound and transmits a signal, by means of magnetic induction, to a subcutaneous transducer. From a coil located within the subcutaneous transducer, alternating current is conducted by a pair of leads to the coil of the transducer implanted within the middle ear. That coil is more rigidly affixed to the housing's interior wall than is the magnet also located therein.

When the alternating current is delivered to the middle ear housing, attractive and repulsive forces are generated by the interaction between the magnet and the coil. Because the coil is more rigidly attached to the housing than the magnet assembly, the coil and housing move together as a unit as a result of the forces produced. The vibrating transducer triggers sound perception of the highest quality when the relationship between the housing's displacement and the coil's current is substantially linear. Such linearity is best achieved by positioning and maintaining the coil within the substantially uniform flux field produced by the magnet assembly.

For the transducer to operate effectively, it must vibrate the ossicles with enough force so that the vibrations are transferred to the cochlear fluid within the inner ear. The force of the vibrations created by the transducer can be optimized by maximizing both the mass of the magnet assembly relative to the combined mass of the coil and the housing, and the energy product (EP) of the permanent magnet.

The transducer is preferably affixed to the ossicles or to the oval window. Attachment in those locations prevents the transducer from contacting bone and tissue, which would absorb the mechanical energy it produces. When the transducer is attached to the ossicles, a biocompatible clip is generally used. However, in an alternate transducer design, the housing contains an opening that results in it being annular in shape; such a design allows the housing to be positioned around the stapes or the malleus. In other embodiments, the transducer is attached to total ossicular replacement prostheses (TORPs) or partial ossicular replacement prostheses (PORPs).

II. PRE-OPERATIVE PROCEDURE

Presently, patients with hearing losses above 50 dB are thought to be the best candidates for the device; however, deaf patients are not potential candidates. Patients suffering from mild to mild-to-moderate hearing losses may, in the future, be found to be potential candidates for the device. Extensive audiologic pre-operative testing is essential both to identify patients who would benefit from the device and to provide baseline data for comparison with post-operative results. In addition, such testing may allow identification of patients who could benefit from an additional procedure at the time that the device is surgically implanted.

Following identification of a potential recipient of the device, appropriate patient counseling should ensue. The goal of such counseling is for the surgeon and the audiologist to provide the patient with all the information needed to make an informed decision regarding whether to opt for the device instead of conventional treatment. The ultimate decision as to whether a patient might substantially benefit from the invention includes both the patient's audiometric data and medical history and the patient's feelings regarding implantation of such a device. To assist in the decision, the patient should be informed of potential adverse effects, the most common of which is a slight shift in residual hearing. More serious adverse effects include the potential for full or partial facial paralysis resulting from damage to the facial nerve during surgery. In addition, the inner ear may also be damaged during placement of the device. Although uncommon due to the use of biocompatible materials, immunologic rejection of the device could conceivably occur.

Prior to surgery, the surgeon needs to make several patient-management decisions. First, the type of anesthetic, either general or local, needs to be chosen; a local anesthetic enhances the opportunity for intra-operative testing of the device. Second, the particular transducer embodiment (e.g., attachment by an incus clip or a PORP) that is best suited for the patient needs to be ascertained. However, other embodiments should be available during surgery in the event that an alternative embodiment is required.

III. SURGICAL PROCEDURE

The surgical procedure for implantation of the implantable portion of the device can be reduced to a seven-step process. First, a modified radical mastoidectomy is performed, whereby a channel is made through the temporal bone to allow for adequate viewing of the ossicles, without disrupting the ossicular chain. Second, a concave portion of the mastoid is shaped for the placement of the receiver coil. The middle ear is further prepared for the installation of the implant embodiment, if required; that is to say, other necessary surgical procedures may also be performed at this time. Third, the device (which comprises, as a unit, the transducer connected by leads to the receiving coil) is inserted through the surgically created channel into the middle ear. Fourth, the transducer is installed in the middle ear and the device is crimped or fitted into place, depending on which transducer embodiment is utilized. As part of this step, the leads are placed in the channel. Fifth, the receiver coil is placed within the concave portion created in the mastoid. (See step two, above.) Sixth, after reviving the patient enough to provide responses to audiologic stimuli, the patient is tested intra-operatively following placement of the external amplification system over the implanted receiver coil. In the event that the patient fails the intra-operative tests or complains of poor sound quality, the surgeon must determine whether the device is correctly coupled and properly placed. Generally, unfavorable test results are due to poor installation, as the device requires a snug fit for optimum performance. If the device is determined to be non-operational, a new implant will have to be installed. Finally, antibiotics are administered to reduce the likelihood of infection, and the patient is closed.

IV. POST-OPERATIVE PROCEDURE

Post-operative treatment entails those procedures usually employed after similar types of surgery. Antibiotics and pain medications are prescribed in the same manner that they would be following any mastoid surgery, and normal activities that will not impede proper wound healing can be resumed within a 24–48 hour period after the operation. The patient should be seen 7–10 days following the operation in order to evaluate wound healing and remove stitches.

Following proper wound healing, fitting of the external amplification system and testing of the device is conducted by a dispensing audiologist. The audiologist adjusts the device based on the patient's subjective evaluation of that position which results in optimal sound perception. In addition, audiological testing should be performed without the external amplification system in place to determine if the surgical implantation affected the patient's residual hearing. A final test should be conducted following all adjustments in order to compare post-operative audiological data with the pre-operative baseline data.

The patient should be seen about thirty days later to measure the device's performance and to make any necessary adjustments. If the device performs significantly worse than during the earlier post-operative testing session, the patient's progress should be closely followed; surgical adjustment or replacement may be required if audiological results do not improve. In those patients where the device performs satisfactorily, semi-annual testing, that can eventually be reduced to annual testing, should be conducted.

DETAILED DESCRIPTION OF THE PREFERRED EMBODIMENTS

Figure 2:
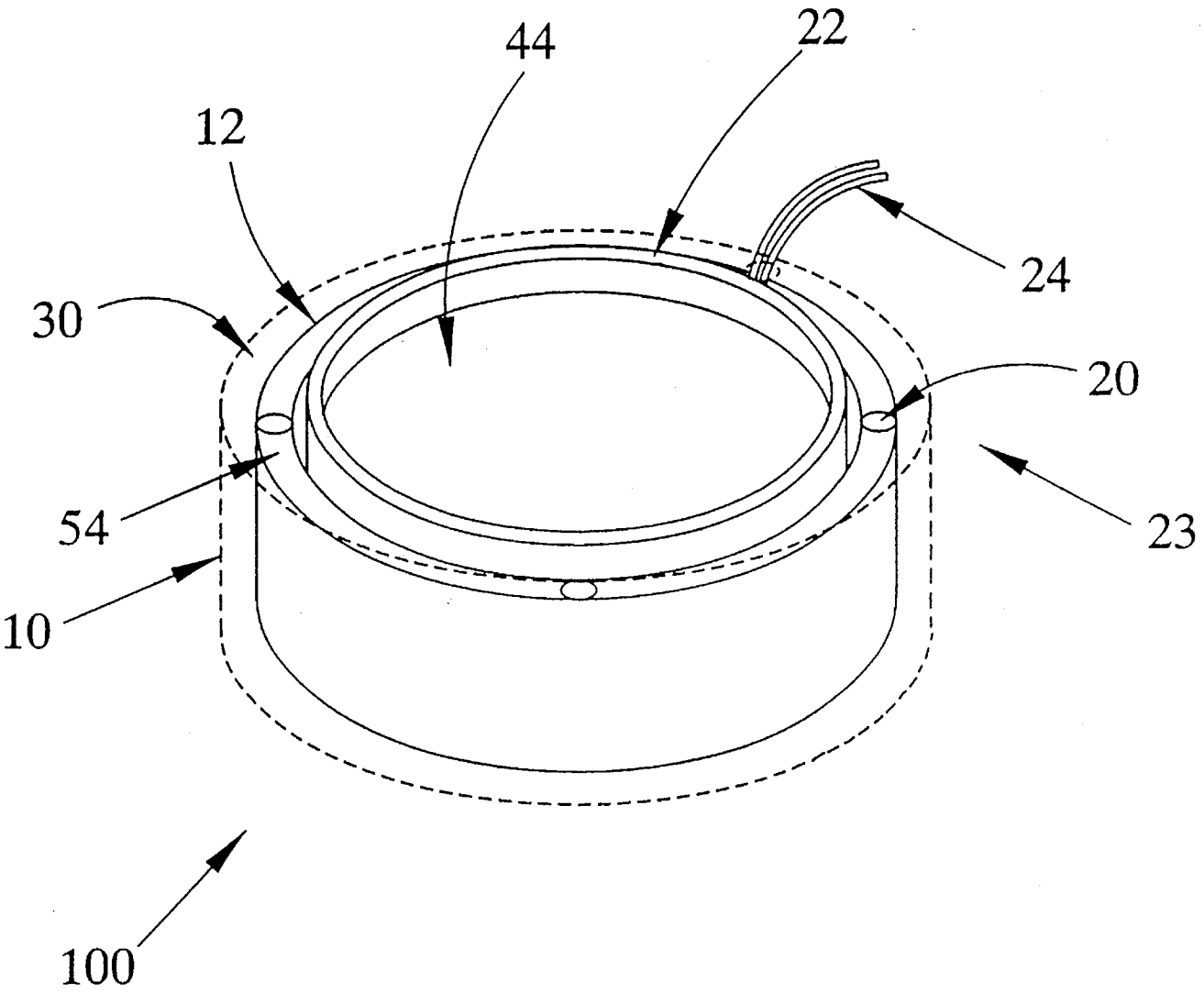
FIG. 2 is a partial perspective view of a transducer according to the present invention.

The structure of an exemplary embodiment of a transducer according to the present invention is shown in FIGS. 1 and 2. The implantable transducer 100 of the present invention is generally comprised of a sealed housing 10 having a magnet assembly 12 and a coil 14 disposed inside it. The magnet assembly is loosely suspended within the housing, and the coil is rigidly secured to the housing. As will be described, the magnet assembly 12 preferably includes a permanent magnet and associated pole pieces. When alternating current is conducted to the coil, the coil and magnet assembly oscillate relative to each other and cause the housing to vibrate. The housing 10 is proportioned to be attached within the middle ear JJ, which comprises the malleus LL, the incus MM, and the stapes HH, collectively known as the ossicles DD, and the region surrounding the ossicles. The exemplary housing is preferably a cylindrical capsule.having a diameter of 1 mm and a thickness of 1 mm, and is made from a biocompatible material, such as titanium. The housing has first and second faces 32, 34 that are substantially parallel to one another and an outer wall 23 which is substantially perpendicular to the faces 32, 34. Affixed to the interior of the housing is an interior wall 22 which defines a circular region and which runs substantially parallel to the outer wall 23.

The magnet assembly 12 and coil 14 are sealed inside the housing. Air spaces 30 surround the magnet assembly so as to separate it from the interior of the housing and to allow it to oscillate freely without colliding with the coil or housing. The magnet assembly is connected to the interior of the housing by flexible membranes such as silicone buttons 20. The magnet assembly may alternatively be floated on a gelatinous medium such as silicon gel which fills the air spaces in the housing. A substantially uniform flux field is produced by configuring the magnet assembly as shown in FIG. 1. The assembly includes a permanent magnet 42 positioned with ends 48, 50 containing the north and south poles substantially parallel to the circular faces 32, 34 of the housing. A first cylindrical pole piece 44 is connected to the end 48 containing the south pole of the magnet and a second pole piece 46 is connected to the end 50 containing the north pole. The first pole piece 44 is oriented with its circular faces parallel to the circular faces 32, 34 of the housing 10. The second pole piece 46 has a circular face which has a rectangular cross-section and which is parallel to the circular faces 32, 34 of the housing. The second pole piece 46 additionally has a wall 54 which is parallel to the wall 23 of the housing and which surrounds the first pole piece 44 and the permanent magnet 42.

The pole pieces must be manufactured out of a magnetic material such as SmCo. They provide a path for the magnetic flux of the permanent magnet 42 which is less resistive than the air surrounding the permanent magnet 42. The pole pieces conduct much of the magnetic flux and thus cause it to pass from the second pole piece 46 to the first pole piece 44 at the gap in which the coil 14 is positioned.

For the device to operate properly, it must vibrate the ossicles with sufficient force to transfer vibrations to the cochlear fluid. The force of vibrations are best maximized by maximizing two parameters: the mass of the magnet assembly relative to the combined mass of the coil and housing, and the energy product (EP) of the permanent magnet 42.

The ratio of the mass of the magnet assembly to the combined mass of the coil and housing is most easily maximized by constructing the housing of a thinly machined, lightweight material such as titanium and by configuring the magnet assembly to fill a large portion of the space inside the housing, although there must be adequate spacing between the magnet assembly and the housing and coil for the magnet assembly to swing freely within the housing.

The magnet should preferably have a high energy product. NdFeB magnets having energy products of thirty-four and SmCo magnets having energy products of twenty-eight are presently available. A high energy product maximizes the attraction and repulsion between the magnetic fields of the coil and magnet assembly and thereby maximizes the force of the oscillations of the transducer. Although it is preferable to use permanent magnets, electromagnets may also be used in carrying out the present invention.

The coil 14 partially encircles the magnet assembly 12 and is fixed to the interior wall 22 of the housing 10 such that the coil is more rigidly fixed to the housing than the magnet assembly. Air spaces separate the coil from the magnet assembly. A pair of leads 24 are connected to the coil and pass through an opening 26 in the housing to the exterior of the transducer, through the surgically-created channel in the temporal bone (indicated as CT in FIG. 8), and attach to a subcutaneous coil 28. The subcutaneous coil 28, which is preferably implanted beneath the skin behind the ear, delivers alternating current to the coil 14 via the leads 24. The opening 26 is closed around the leads 24 to form a seal (not shown) which prevents contaminants from entering the transducer.

The perception of sound which the vibrating transducer ultimately triggers is of the highest quality when the relationship between the displacement of the housing 10 and the current in the coil 14 is substantially linear. For the relationship to be linear, there must be a corresponding displacement of the housing for each current value reached by the alternating current in the coil. Linearity is most closely approached by positioning and maintaining the coil within the substantially uniform flux field 16 produced by the magnet assembly.

When the magnet assembly, coil, and housing are configured as in FIG. 1, alternating current in the coil causes the housing to oscillate side-to-side in the directions indicated by arrows in FIG. 1. The transducer is most efficient when positioned such that the side-to-side movement of the housing produces side-to-side movement of the oval window EE as indicated by arrows in FIG. 3*a*.

Figure 3A:
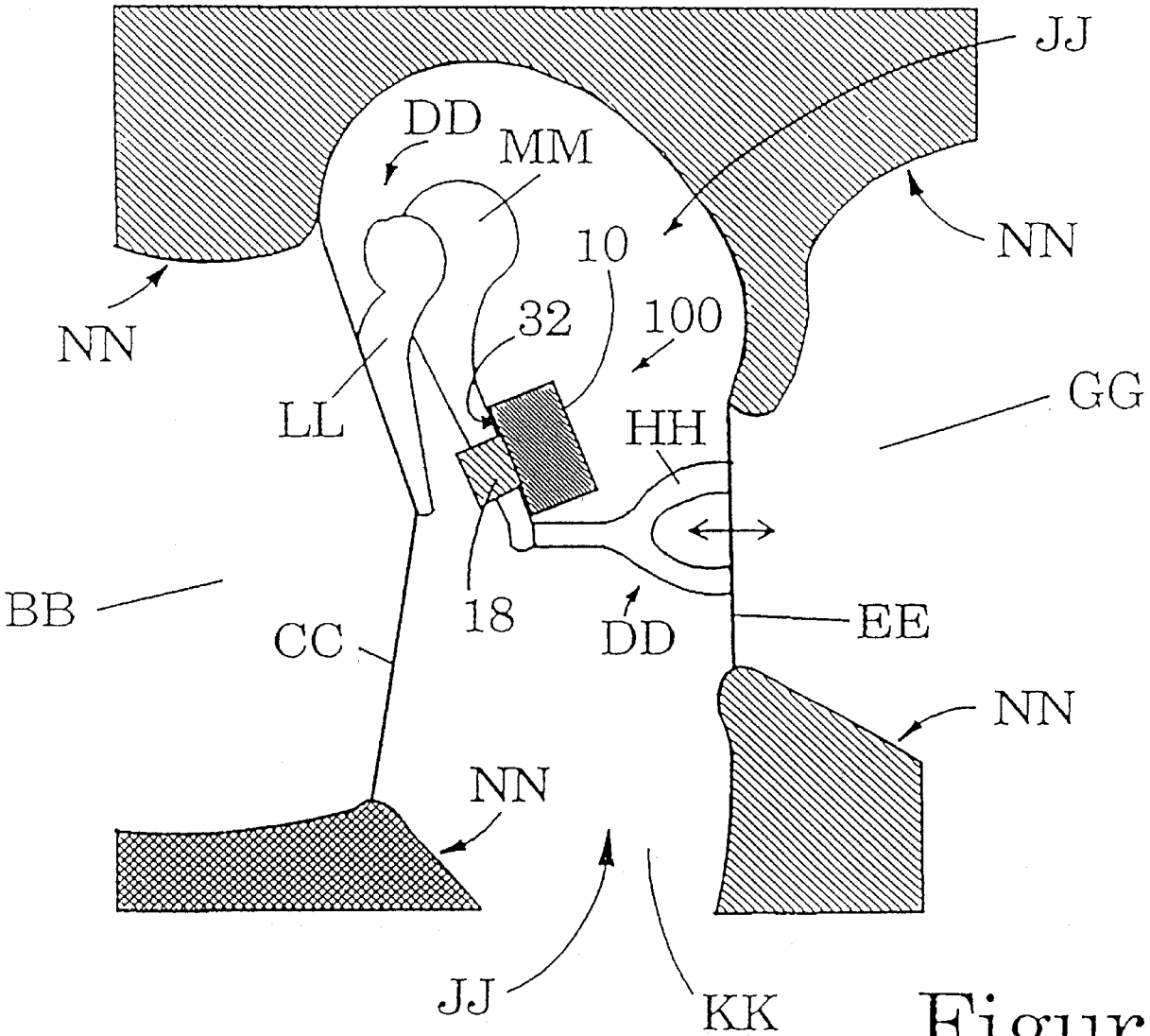
FIG. 3*a* is a schematic representation of a portion of the auditory system showing a transducer connected to a incus of the middle ear.
Figure 3B:
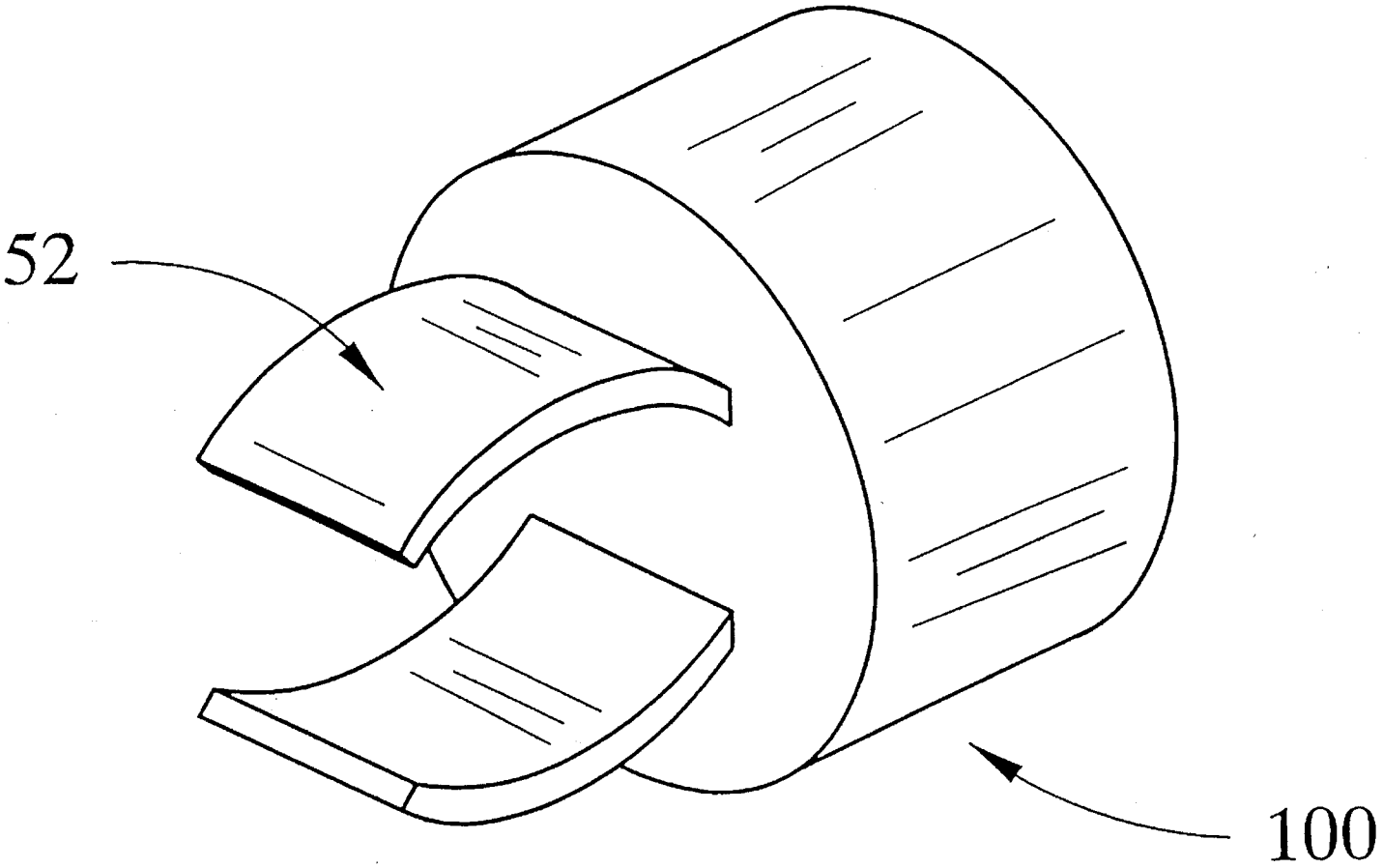
FIG. 3*b* is a perspective view of a transducer according to the present invention.

The transducer may be affixed to various structures within the ear. FIG. 3*a* shows a transducer 100 attached to an incus MM by a biocompatible clip 18 which is secured to one of the circular faces 32 of the housing 10 and which at least partially surrounds the incus MM. The clip 18 holds the transducer firmly to the incus so that the vibrations of the housing which are generated during operation are conducted along the bones of the middle ear to the oval window EE of the inner ear and ultimately to the cochlear fluid as described above. An exemplary clip 18, shown in FIG. 3*b*, includes two pairs of titanium prongs 52 which have a substantially arcuate shape and which may be crimped tightly around the incus.

The transducer 100 must be connected substantially exclusively to the ossicles DD or the oval window EE. The transducer must be mechanically isolated from the bone and tissue which surrounds the middle ear since these structures will tend to absorb the mechanical energy produced by the transducer. It is therefore preferable to secure the transducer 100 to only the ossicles DD or oval window EE and to thereby isolate it from the surrounding region NN (FIG. 3*a*). For the purposes of this description, the surrounding region consists of all structures in and surrounding the external, middle, and internal ear other than the ossicles DD, tympanic membrane CC, oval window EE and any structures connecting them with each other.

Figure 4:
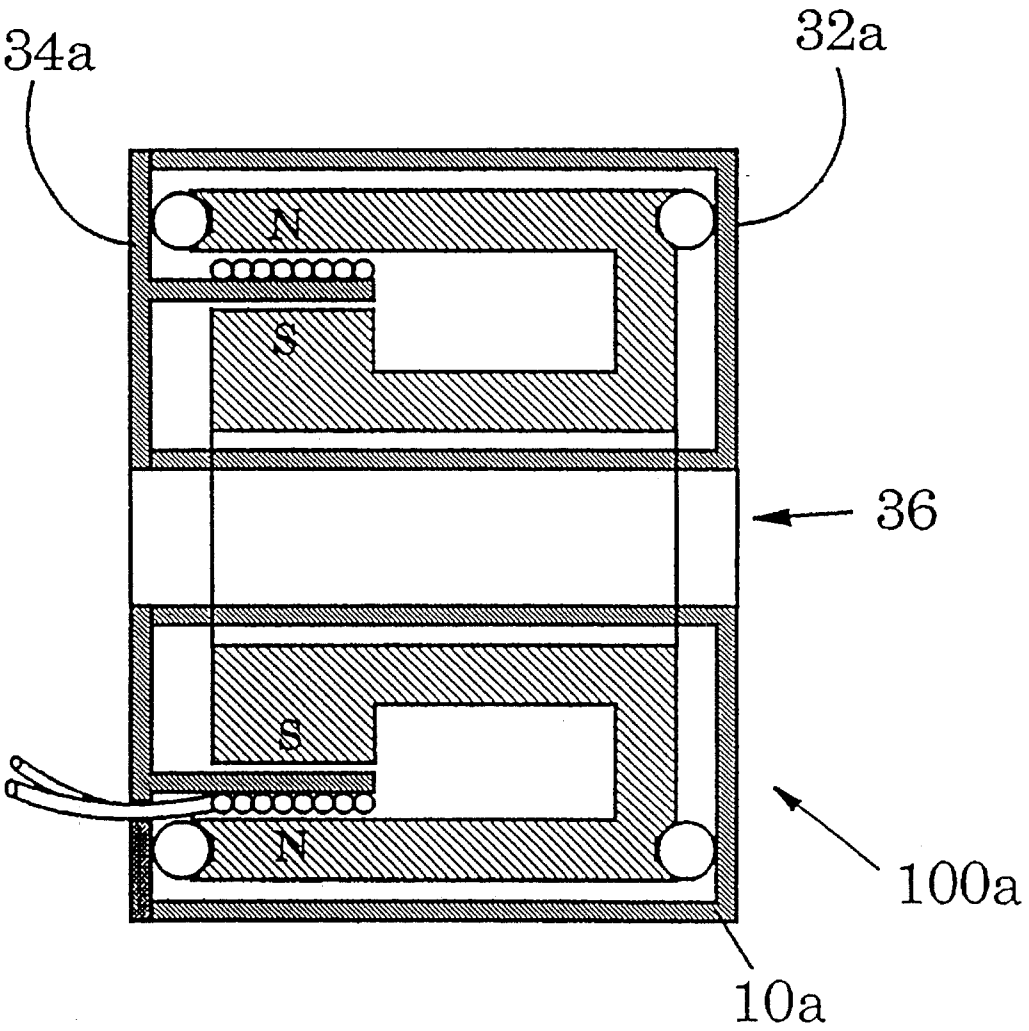
FIG. 4 is a cross-sectional side view of an alternate embodiment of a transducer according to the invention.
Figure 5:
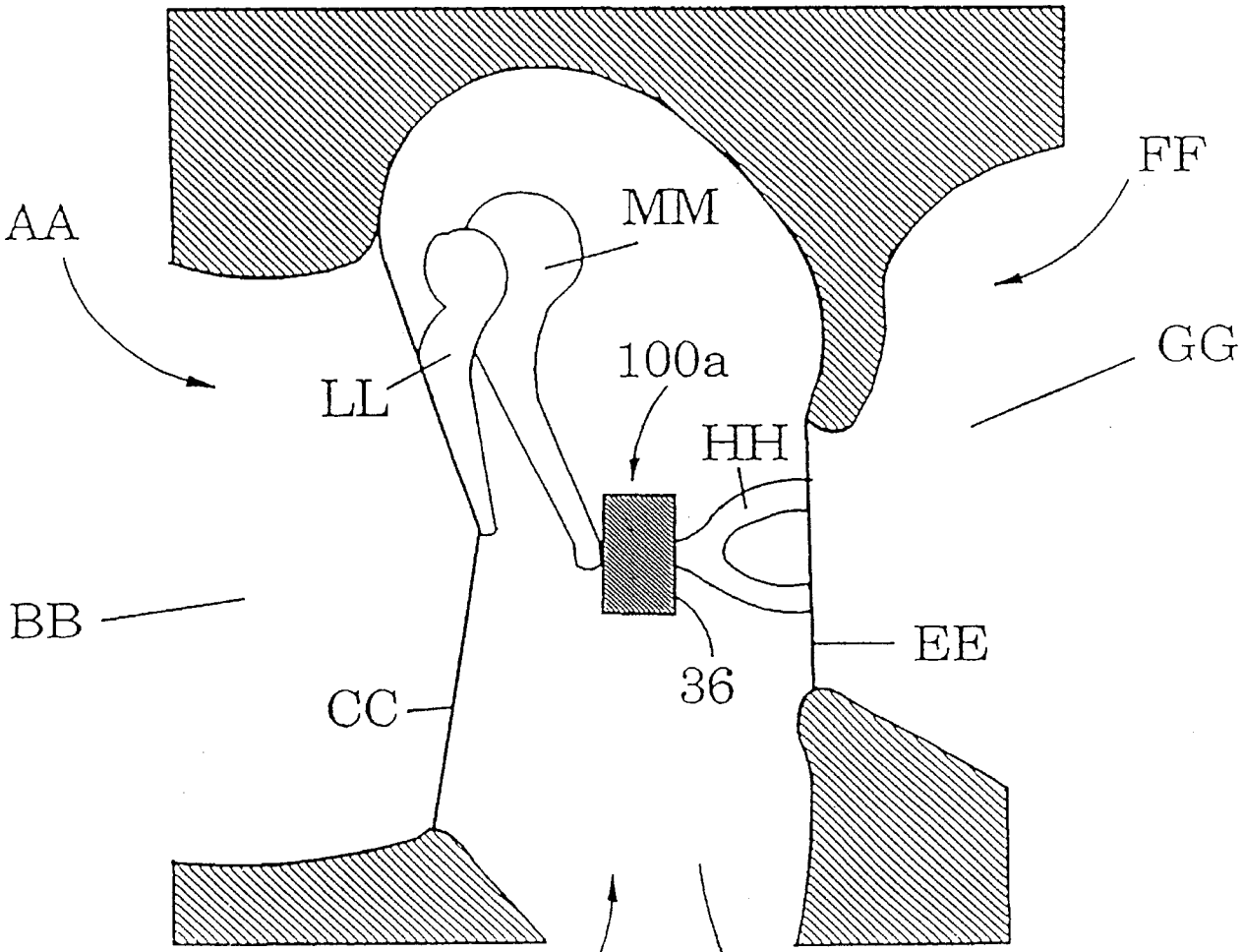
FIG. 5 is a schematic representation of a portion of the auditory system showing the embodiment of FIG. 4 positioned around a portion of a stapes of the middle ear.

An alternate transducer 100*a* having an alternate mechanism for fixing the transducer to structures within the ear is shown in FIGS. 4 and 5. In this alternate transducer 100*a*, the housing 10*a* has an opening 36 passing from the first face 32*a* to the second face 34*a* of the housing and is thereby annular shaped. When implanted, a portion of the stapes HH is positioned within the opening 36. This is accomplished by separating the stapes HH from the incus MM and slipping the O-shaped transducer around the stapes HH. The separated ossicles are then returned to their natural position, and they reconnect when the connection tissue between then heals. This embodiment may be secured around the malleus in a similar fashion.

Figure 6:
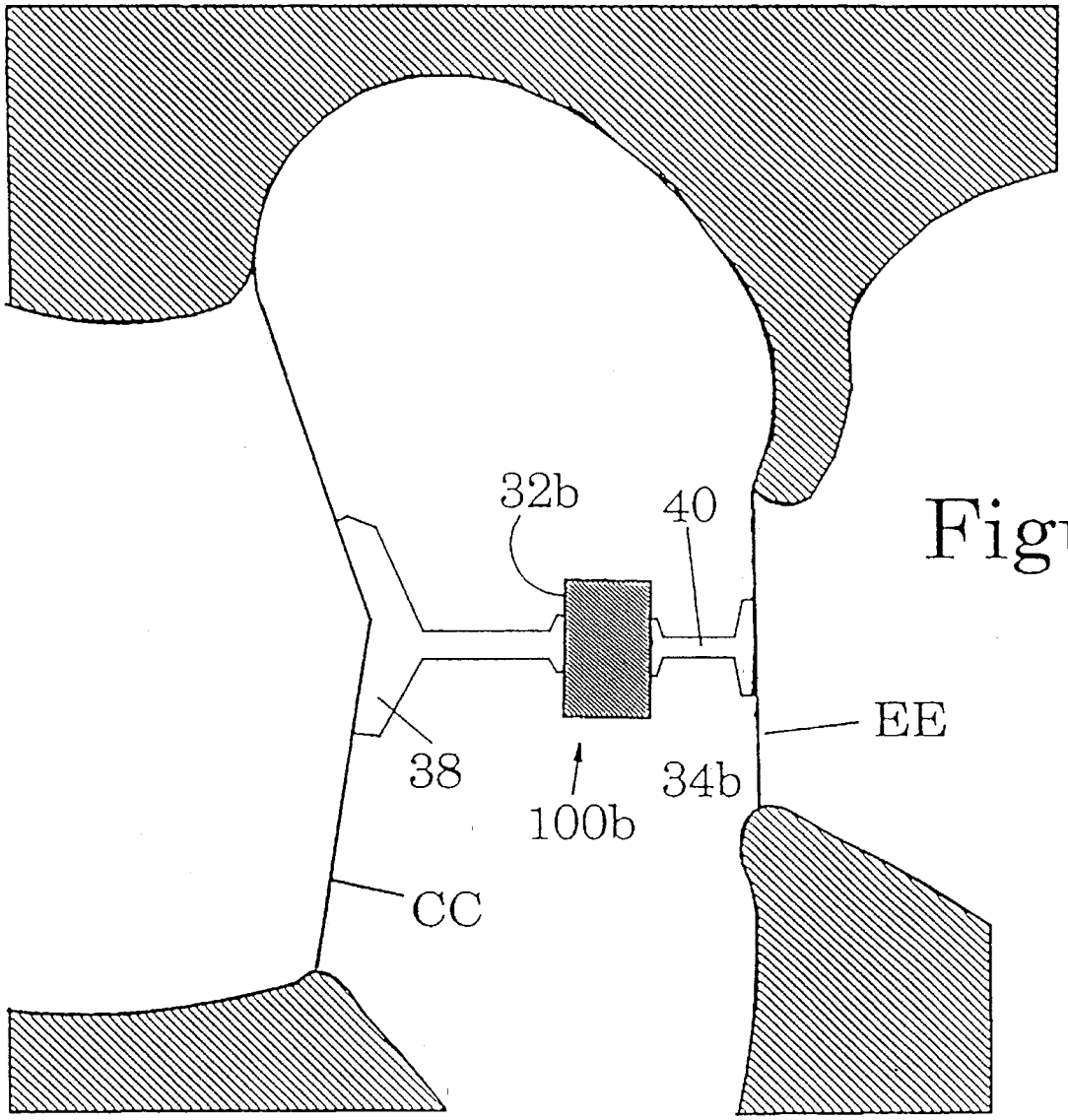
FIG. 6 is a schematic representation of a portion of the auditory system showing a transducer of the present invention and a total ossicular replacement prosthesis secured within the ear.
Figure 7:
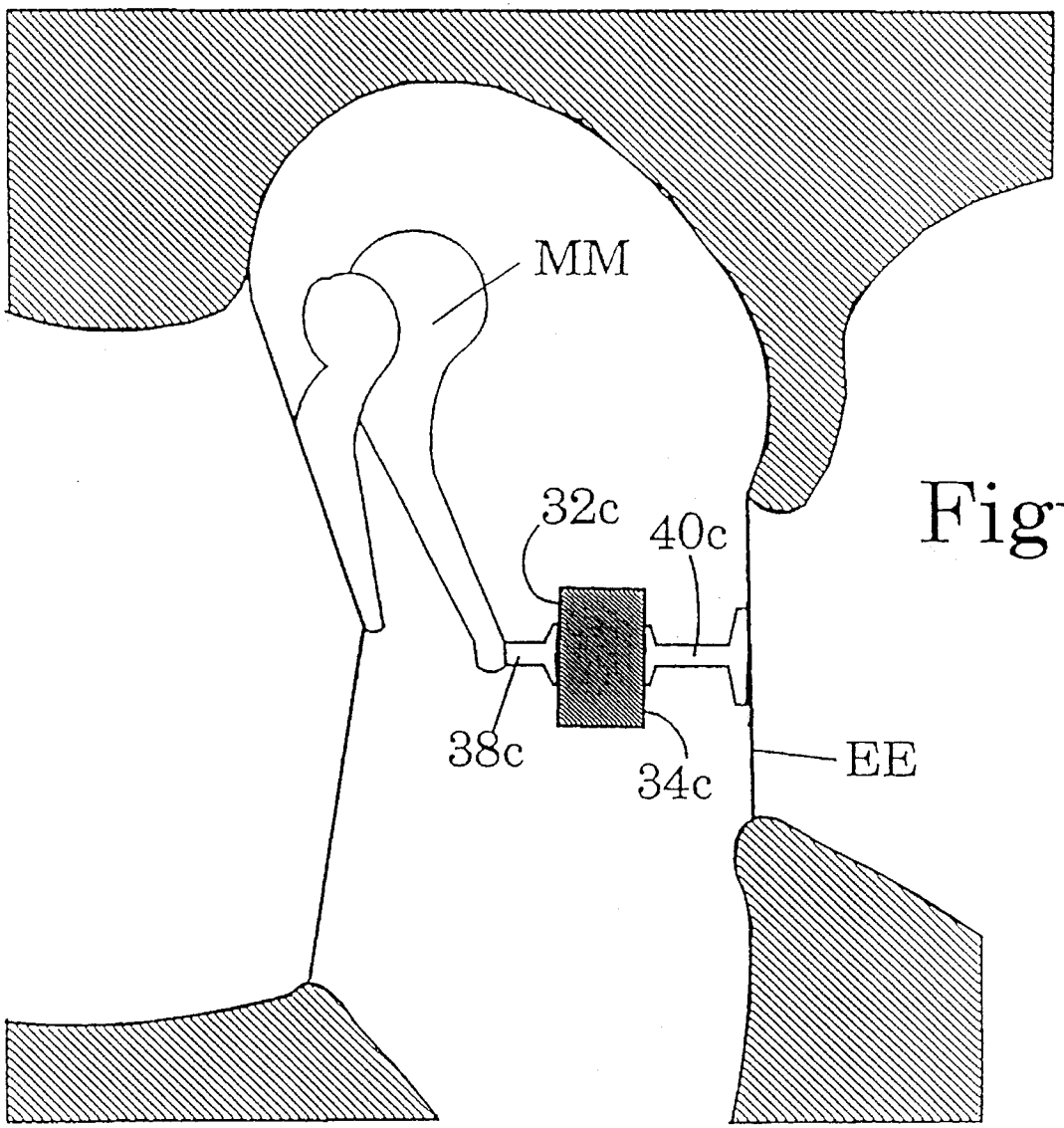
FIG. 7 is a schematic representation of a portion of the auditory system showing a transducer of the present invention and a partial ossicular replacement prosthesis secured within the ear.

FIGS. 6 and 7 illustrate the use of the transducer of the present invention in combination with total ossicular replacement prostheses (TORPs) or partial ossicular replacement prostheses (PORPS). These illustrations are merely representative; other designs incorporating the transducer into TORPs and PORPs may be easily envisioned.

TORPs and PORPs are constructed from biocompatible materials such as titanium. Often during ossicular reconstruction surgery the TORPs and PORPs are formed in the operating room as needed to accomplish the reconstruction. As shown in FIG. 6, a TORP may be comprised of a pair of members 38, 40 connected to the circular faces 32*b*, 34*b* of the transducer 100*b*. The TORP is positioned between the tympanic membrane CC and the oval window EE and is preferably of sufficient length to be held into place by friction. Referring to FIG. 7, a PORP may be comprised of a pair of members 38*c*, 40*c* connected to the circular faces 32*c*, 34*c* of the transducer positioned between the incus MM and the oval window EE.

Figure 8:
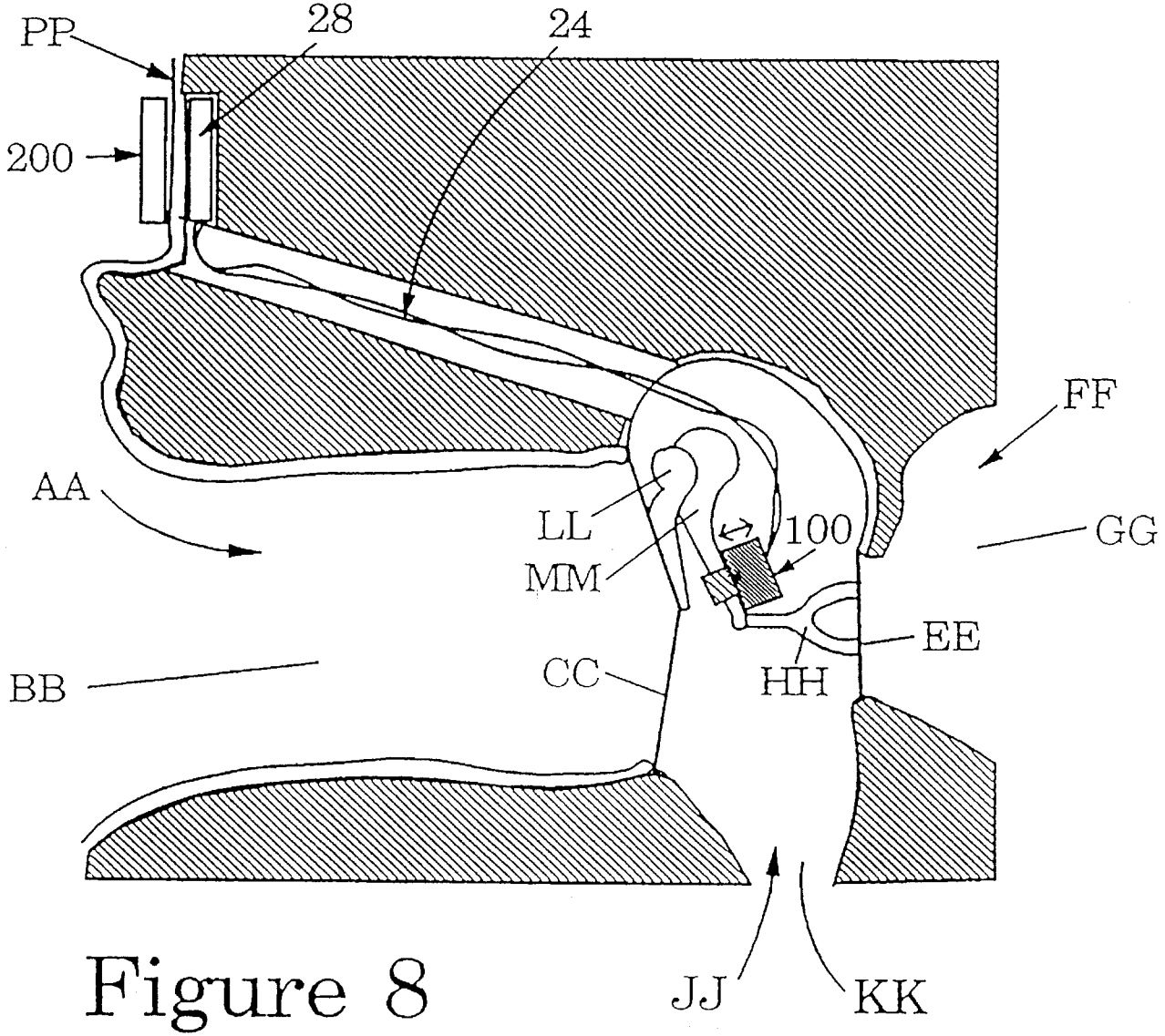
FIG. 8 is a schematic representation of a portion of the auditory system showing a transducer of the present invention positioned for receiving alternating current from a subcutaneous coil inductively coupled to an external sound transducer positioned outside a patient's head.
Figure 9:
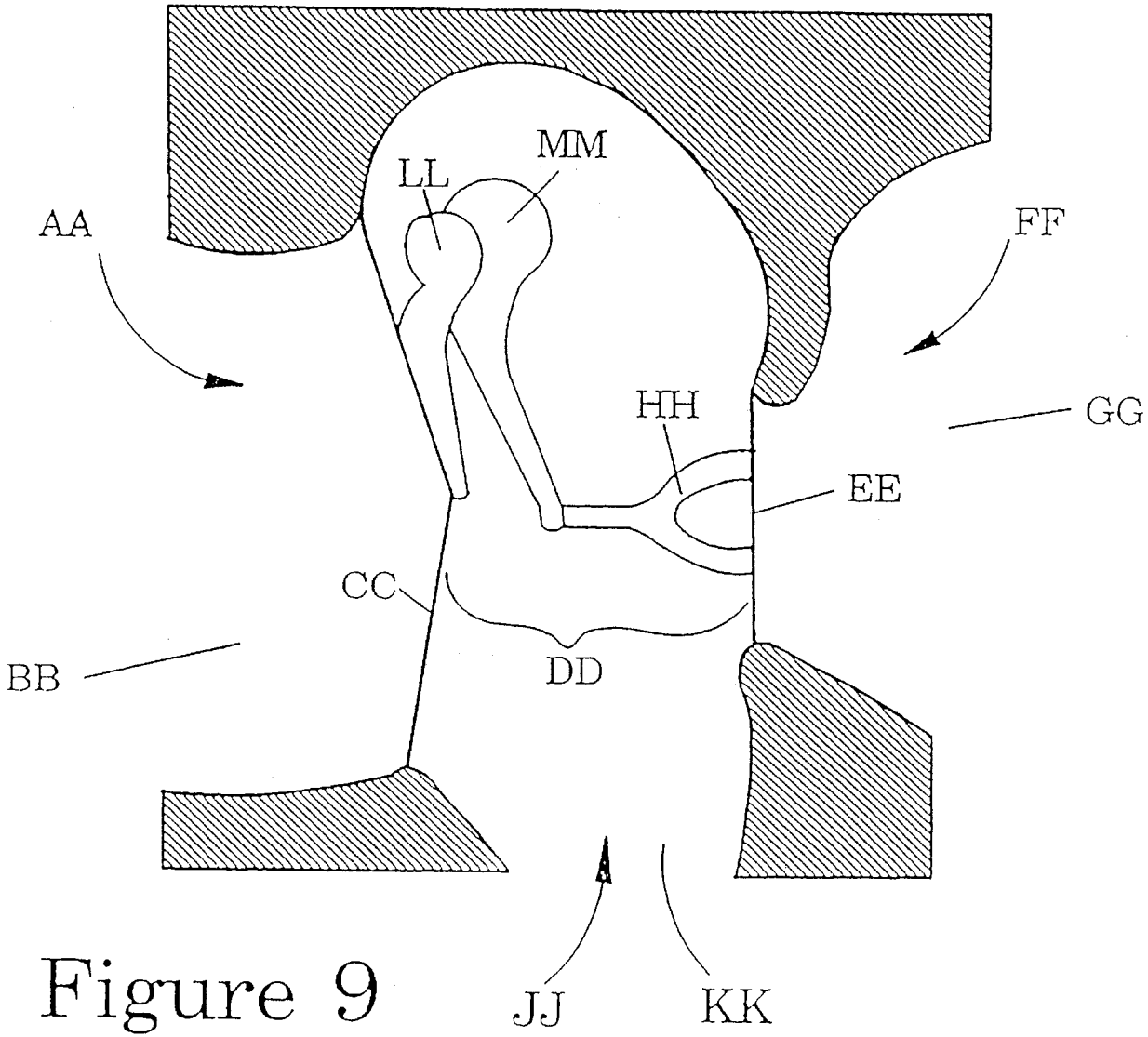
FIG. 9 is a schematic representation of a portion of the human auditory system.

FIG. 8 shows a schematic representation of a transducer 100 and related components positioned within a patient's skull PP. An external sound transducer 200 is substantially identical in design to a conventional hearing aid transducer and is comprised of a microphone, sound processing unit, amplifier, battery, and external coil, none of which are depicted in detail. The external sound transducer 200 is positioned on the exterior of the skull PP. A subcutaneous sound transducer 28 is connected to the leads 24 of the transducer 100 and is positioned under the skin behind the ear such that the external coil is positioned directly over the location of the subcutaneous coil 28.

Sound waves are detected and converted to an electrical signal by the microphone and sound processor of the external sound transducer 200. The amplifier amplifies the signal and delivers it to the external coil which subsequently delivers the signal to the subcutaneous coil 28 by magnetic induction. When the alternating current representing the sound wave is delivered to the coil 14 in the implantable transducer 100, the magnetic field produced by the coil interacts with the magnetic field of the magnet assembly 12.

As the current alternates, the magnet assembly and the coil alternately attract and repel one another and, with the alternate attractive and repulsive forces causing the magnet assembly and the coil to alternately move towards and away from each other. Because the coil is more rigidly attached to the housing than is the magnet assembly, the coil and housing move together as a single unit. The directions of the alternating movement of the housing are indicated by arrows in FIG. 8. The vibrations are conducted via the stapes HH to the oval window EE and ultimately to the cochlear fluid.

EXPERIMENTAL

The following examples serve to illustrate certain preferred embodiments and aspects of the present invention and are not to be construed as limiting the scope thereof. The experimental disclosure which follows is divided into: I) In Vivo Cadaver Examples; and II) In Vivo Subjective Evaluation of Speech and Music. These two sections summarize the two approaches employed to obtain in vivo data for the device.

I. IN VIVO CADAVER EXAMPLES

Figure 10:
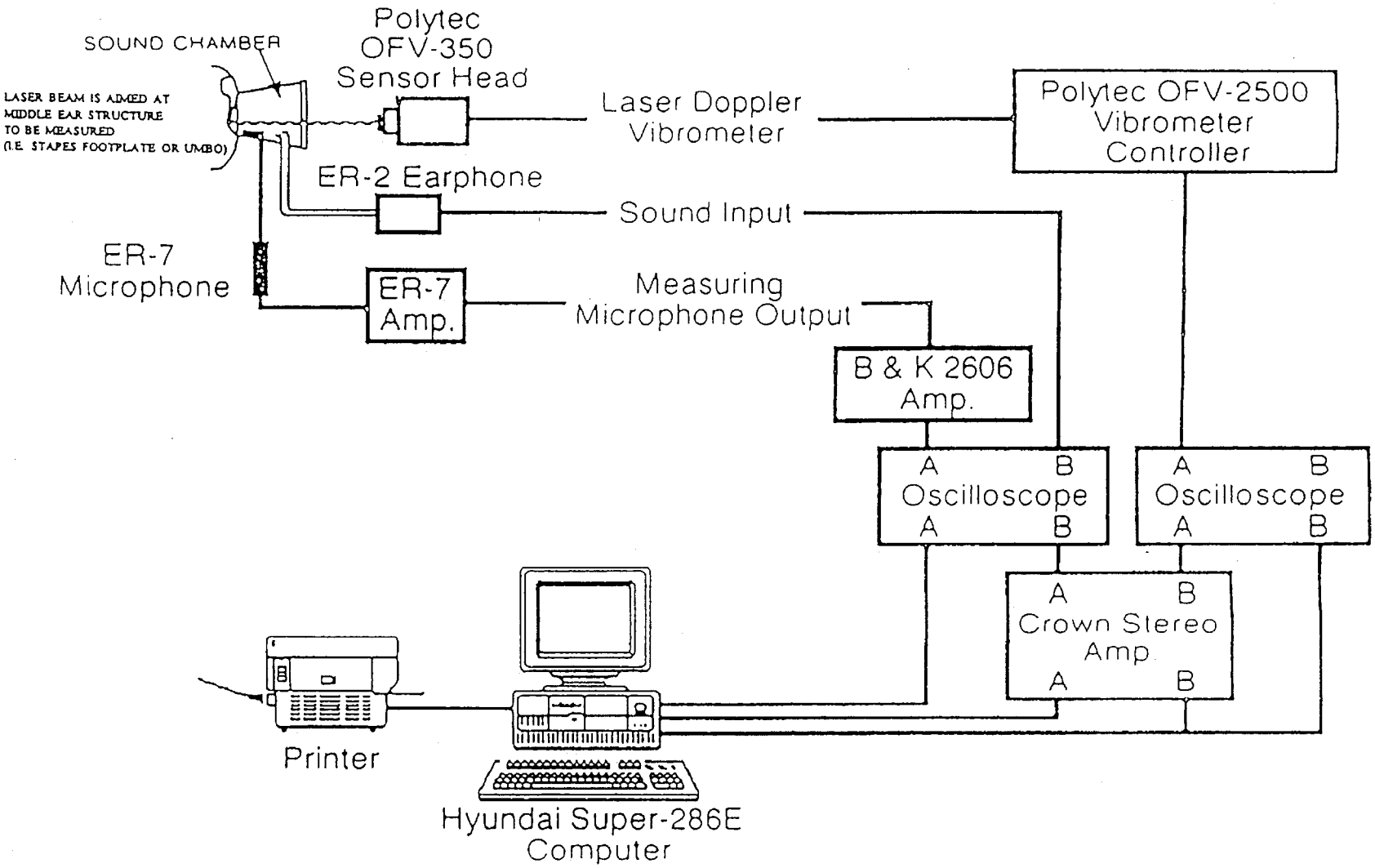
FIG. 10 is an illustration of the system that incorporates a laser Doppler velocimeter (LDV) to measure vibratory motion of the middle ear.
Figure 11:
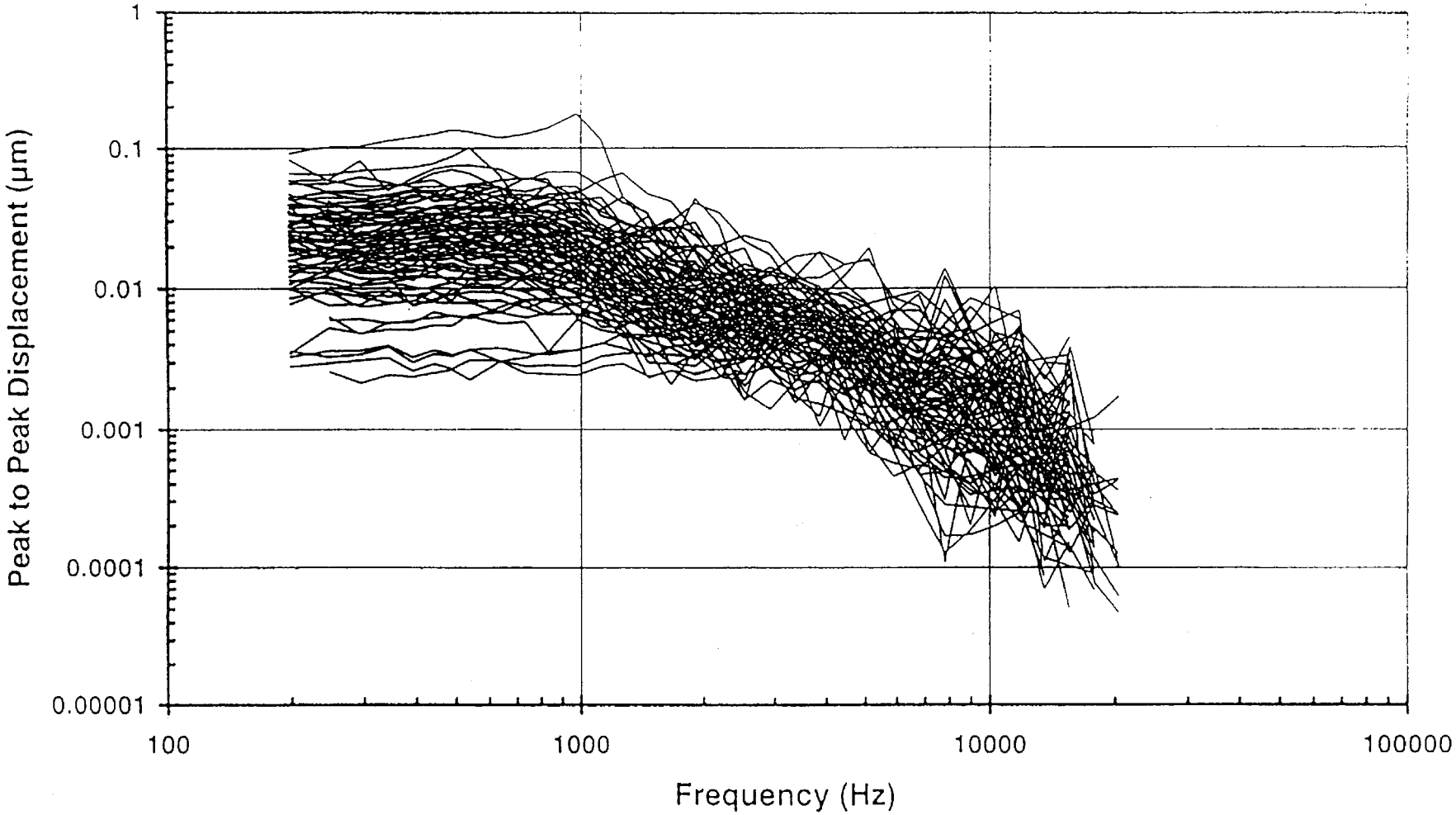
FIG. 11 depicts, by means of a frequency-response curve, the vibratory motion of the live human eardrum as a function of the frequency of sound waves delivered to it.

When sound waves strike the tympanic membrane, the middle ear structures vibrate in response to the intensity and frequency of the sound. In these examples, a laser Doppler velocimeter (LDV) was used to obtain curves of device performance versus pure tone sounds in human cadaver ears. The LDV tool that was used for these examples is located at the Veterans Administration Hospital in Palo Alto, Calif. The tool, illustrated in FIG. 10, has been used extensively for measuring the middle ear vibratory motion and has been described by Goode et al. Goode et al. used a similar system to measure the vibratory motion of the live human eardrum in response to sound, the results of which are depicted in FIG. 11, in order to demonstrate the method's validity and to validate the cadaver temporal bone model.

In each of the three examples that follow, dissection of the human temporal bone included a facial recess approach in order to gain access to the middle ear. After removal of the facial nerve, a small target 0.5 mm by 0.5 mm square was placed on the stapes footplate; the target is required in order to facilitate light return to the LDV sensor head.

Sound was presented at 80 dB sound pressure level (SPL) at the eardrum in each example and measured with an ER-7 probe microphone 3 mm away from the eardrum. An ER-2 earphone delivered pure tones of 80 dB SPL in the audio range. The sound level was kept constant for all frequencies. The displacement of the stapes in response to the sound was measured by the LDV and recorded digitally by a computer which utilizes FFT (Fast Fourier Transform); the process has been automated by a commercially available software program (Tymptest), written for the applicant's lab, exclusively for testing human temporal bones.

In each example, the first curve of stapes vibration in response to sound served as a baseline for comparison with the results obtained with the device.

EXAMPLE 1

Transducer 4*b*

Figure 12:
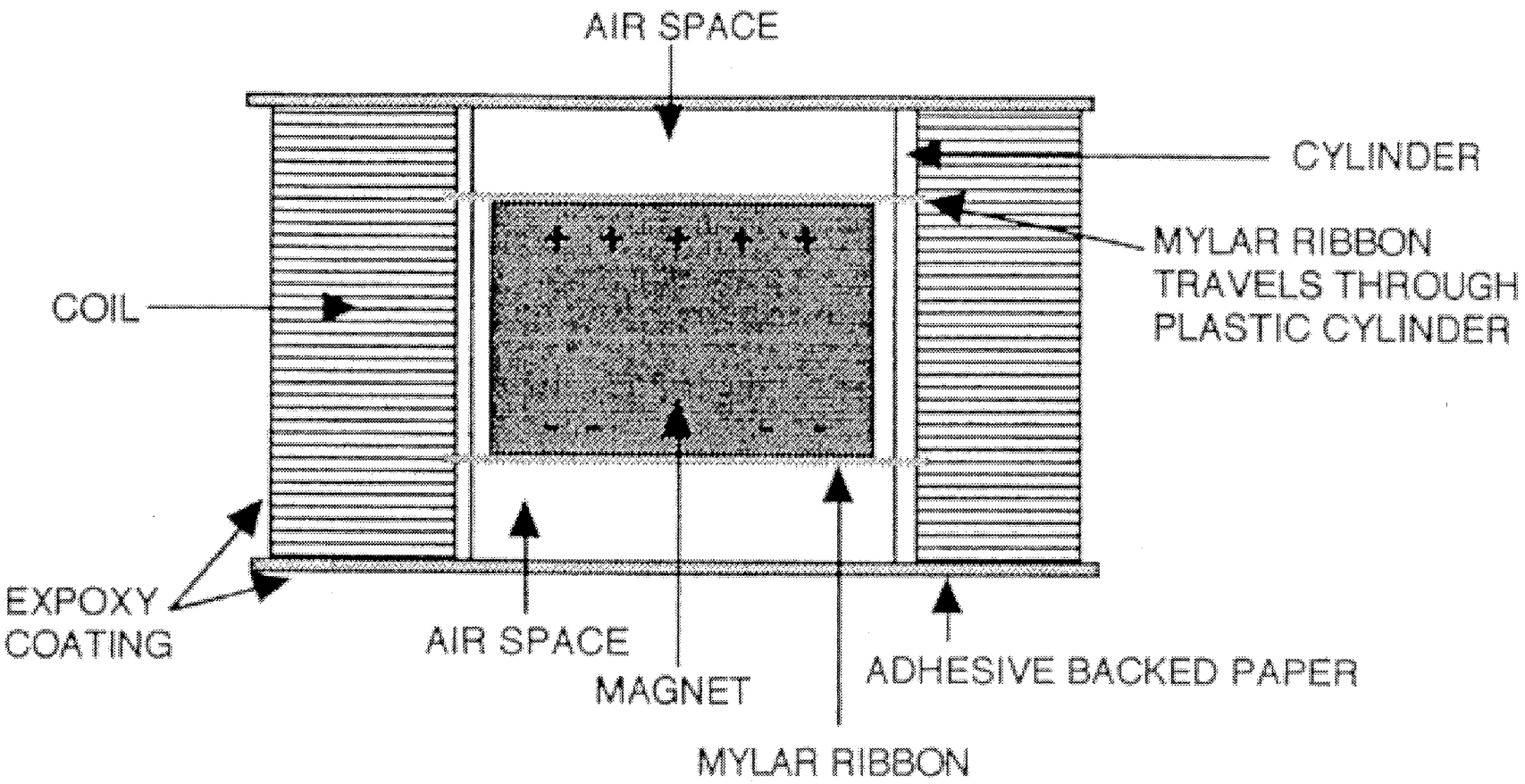
FIG. 12 is a cross-sectional view of a transducer (Transducer 4*b*) placed between the incus and the malleus during cadaver experimentation.

Transducer Construction: A 4.5 mm diameter by 2.5 mm length transducer, illustrated in FIG. 12, used a 2.5 mm diameter NdFeB magnet. A mylar membrane was glued to a 2 mm length by 3 mm diameter plastic drinking straw so that the magnet was inside the straw. The tension of the membrane was tested for what was expected to be the required tension in the system by palpating the structure with a tooth pick. A 5 mm biopsy punch was used to punch holes into an adhesive-backed piece of paper. One of the resulting paper-backed adhesive disks was placed, adhesive side down, on each end of the assembly making sure the assembly was centered on the adhesive paper structure. A camel hair brush was used to carefully apply white acrylic paint to the entire outside surface of the bobbin-shaped structure. The painted bobbin was allowed to dry between multiple coats. This process strengthened the structure. Once the structure was completely dry, the bobbin was then carefully wrapped with a 44 gauge wire. After an adequate amount of wire was wrapped around the bobbin, the resulting coil was also painted with the acrylic paint in order to prevent the wire from spilling off the structure. Once dried, a thin coat of five-minute epoxy was applied to the entire outside surface of the structure and allowed to dry. The resulting leads were then stripped and coated with solder.

Methodology: The transducer was placed between the incus and the malleus and moved into a "snug fit" position. The transducer was connected to the Crown amplifier output which was driven by the computer pure-tone output. The current was recorded across a 10 ohm resistor in series with Transducer 4*b*. With the transducer in place, the current to the transducer was set at 10 milliamps (mA) and the measured voltage across the transducer was 90 millivolts (mV); the values were constant throughout the audio frequency range although there was a slight variation in the high frequencies above 10 kHz. Pure tones were delivered to the transducer by the computer and the LDV measured the stapes velocity resulting from transducer excitation. The resulting figure was later converted into displacement for purposes of graphical illustration.

Figure 13:
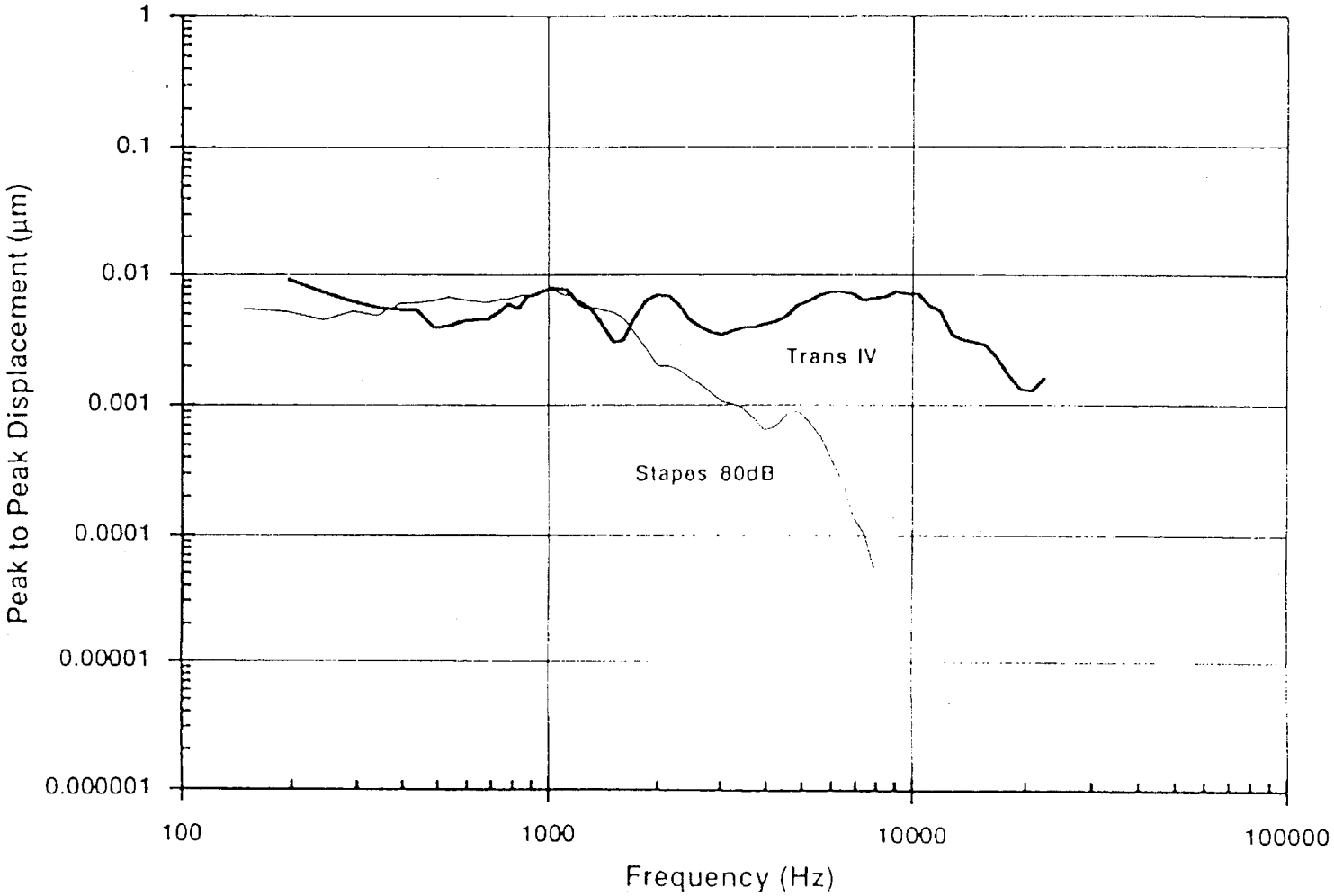
FIG. 13 illustrates through a frequency-response curve that the use of Transducer 4*b* resulted if gain in the high frequency range above 2 kHz.

Results: As FIG. 13 depicts, the transducer resulted in a gain in the high frequencies above 2 kHz but little improvement was observed in the low frequencies below 2 kHz. The data marked a first successful attempt at manufacturing a transducer small enough to fit within the middle ear and demonstrated the device's potential for high fidelity-level performance. In addition, the transducer is designed to be attached to a single ossicle, not held in place by the tension between the incus and the malleus, as was required by the crude prototype used in this example. More advanced prototypes affixed to a single ossicle are expected to result in improved performance.

EXAMPLE 2

Transducer 5

Transducer Construction: A 3 mm diameter by 2 mm length transducer (similar to Transducer 4*b*, FIG. 12) used a 2 mm diameter by 1 mm length NdFeB magnet. A mylar membrane was glued to a 1.8 mm length by 2.5 mm diameter plastic drinking straw so that the magnet was inside the straw. The remaining description of Transducer 5's construction is analogous to that of Transducer 4*b* in Example 1, supra, except that: i) a 3 mm biopsy punch was used instead of a 5 mm biopsy punch; and ii) a 48 gauge, 3 litz wire was used to wrap the bobbin structure instead of a 44 gauge wire.

Methodology: The transducer was glued to the long process of the incus with cyanoacrylate glue. The transducer was connected to the Crown amplifier which was driven by the computer pure-tone output. The current was recorded across a 10 ohm resistor in series with Transducer 5. The current to the transducer was set at 3.3 mA, 4 mA, 11 mA, and 20 mA and the measured voltage across the transducer was 1.2 V, 1.3 V, 1.2 V, and 2.5 V, respectively; the values were constant throughout the audio frequency range although there was a slight variation in the high frequencies above 10 kHz. Pure tones were delivered to the transducer by the computer, while the LDV measured stapes velocity, which was subsequently converted to displacement for graphical illustration.

Figure 14:
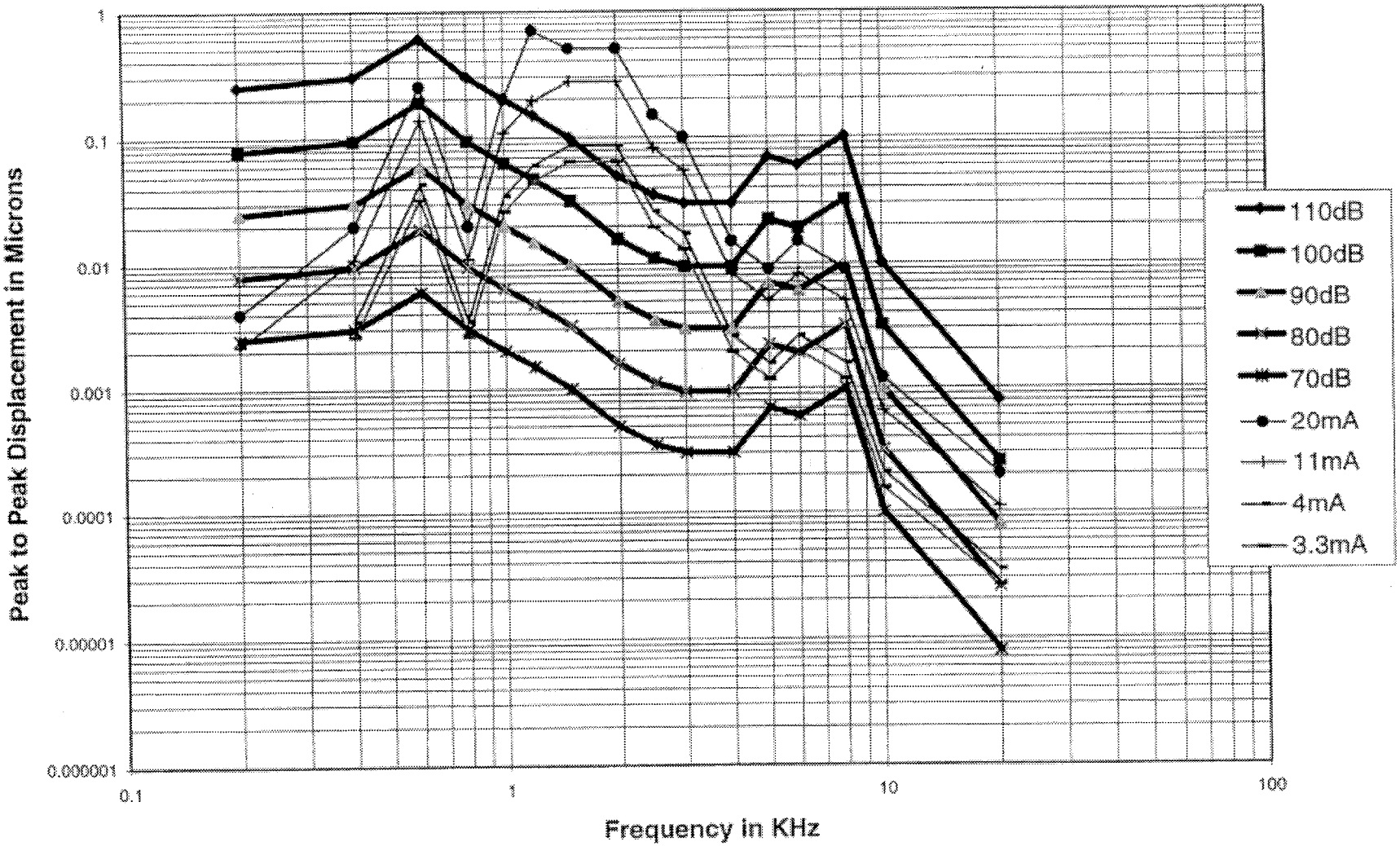
FIG. 14 illustrates through a frequency-response curve that the use of Transducer 5 resulted in marked improvement in the frequencies between 1 and 3.5 kHz with maximum output exceeding 120 dB SPL equivalents when compared with a baseline of stapes vibration when driven with sound.

Results: As FIG. 14 shows, Transducer 5, a much smaller transducer than Transducer 4*b*, demonstrated marked improvement in frequencies between 1 and 3.5 kHz, with maximum output exceeding 120 dB SPL equivalents when compared to stapes vibration when driven with sound.

EXAMPLE 3

Transducer 6

Transducer Construction: A 4 mm diameter by 1.6 mm length transducer used a 2 mm diameter by 1 mm length NdFeB magnet. A soft silicon gel material (instead of the mylar membrane used in Examples 1 and 2) held the magnet in position. The magnet was placed inside a 1.4 mm length by 2.5 mm diameter plastic drinking straw so that the magnet was inside the straw and the silicon gel material was gingerly applied to hold the magnet. The tension of the silicon gel was tested for what was expected to be the required tension in the system by palpating the structure with a tooth pick. The remaining description of the Transducer 6's construction is analogous to that of Transducer 4*b* in Example 1, supra, except that: i) a 4 mm biopsy punch was used instead of a 5 mm biopsy punch; and ii) a 48 gauge, 3 litz wire was used to wrap the bobbin structure instead of a 44 gauge wire.

Methodology: The transducer was placed between the incus and the malleus and moved into a "snug fit" position. The transducer's lead were connected to the output of the Crown amplifier which was driven by the computer pure-tone output. The current was recorded across a 10 ohm precision resistor in series with Transducer 6. In this example, the current to the transducer was set at 0.033 mA, 0.2 mA, 1 mA, 5 mA and the measured voltage across the transducer was 0.83 mV, 5 mV, 25 mV, 125 mV, respectively; these values were constant throughout the audio frequency range although there was a slight variation in the high frequencies above 10 kHz. Pure tones were delivered to the transducer by the computer, while the LDV measured the stapes velocity, which was subsequently converted to displacement for graphical illustration.

Figure 15:
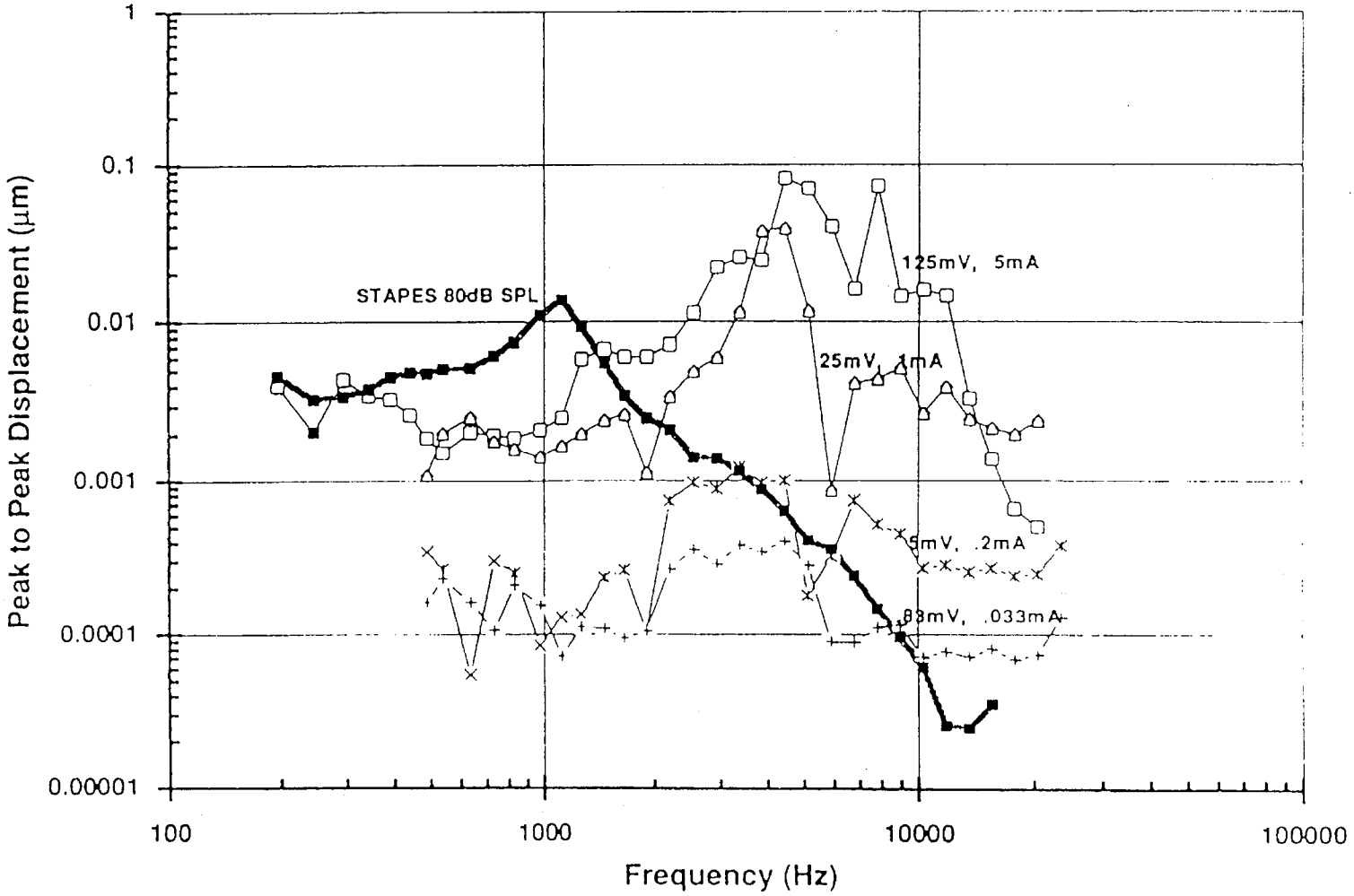
FIG. 15 illustrates through a frequency-response curve that the use of Transducer 6 resulted in marked improvement in the frequencies above 1.5 kHz with maximum output exceeding 120 dB SPL equivalents when compared with a baseline of stapes vibration when driven with sound.

Results: As FIG. 15 depicts, the transducer resulted in marked improvement in the frequencies above 1.5 kHz, with maximum output exceeding 120 dB SPL equivalents when compared to the stapes vibration baseline driven with sound. The crude prototype demonstrated that the device's potential for significant sound improvement, in terms of gain, could be expected for those suffering from severe hearing impairment. As was stated in Example 1, the transducer is designed to be attached to a single ossicle, not held in place by the tension between the incus and the malleus, as was required by the prototype used in this example. More advanced prototypes affixed to a single ossicle are expected to result in improved performance.

II. IN VIVO SUBJECTIVE EVALUATION OF SPEECH AND MUSIC

This example, conducted on living human subjects, resulted in a subjective measure of transducer performance in the areas of sound quality for music and speech. Transducer 5, used in Example 2, supra, was used in this example.

EXAMPLE 4

Methodology: A soft silicon gel impression of a tympanic membrane, resembling a soft contact lens for the eye, was produced, and the transducer was glued to the concave surface of this impression. The transducer and the connected silicon impression were then placed on the subject's tympanic membrane by an otologic surgeon while looking down the subject's external ear canal with a Zeiss OPMI-1 stereo surgical microscope. The device was centered on the tympanic membrane with a non-magnetic suction tip and was held in place with mineral oil through surface tension between the silicon gel membrane and the tympanic membrane. After installation, the transducer's leads were taped against the skin posterior to the auricle in order to prevent dislocation of the device during testing. The transducer's leads were then connected to the Crown D-75 amplifier output. The input to the Crown amplifier was a common portable compact disk (CD) player. Two CDs were used, one featuring speech and the other featuring music. The CD was played and the output level of the transducer was controlled with the Crown amplifier by the subject. The subject was then asked to rate the sound quality of the device.

Results: The example was conducted on two subjects, one with normal hearing and one with a 70 dB "cookie-bite" sensori-neural hearing loss. Both subjects reported excellent sound quality for both speech and music; no distortion was noticed by either subject. In addition, the hearing-impaired subject indicated that the sound was better than the best hi-fidelity equipment that he had heard. One should recall that the transducer is not designed to be implanted in a silicon gel membrane attached to the subject's tympanic membrane. The method described was utilized because the crude transducer prototypes that were tested could never be used in a live human in implanted form, the method was the closest approximation to actually implanting a transducer at the time the test was performed, and the applicant needed to validate the results observed from the In Vivo Cadaver Examples with a subjective evaluation of sound quality.

I claim:

1. A method of improving hearing in a subject, comprising the steps of:

a) providing a device comprising:

i ) a transducer comprising a magnet and a first coil disposed within and attached to a housing, said magnet producing a first magnetic field and said first coil producing a second magnetic field, said first and second magnetic fields interacting to cause vibrations of said housing, ii) a receiving coil, and iii) leads connecting, and allowing for current between, said transducer and said receiving coil;

b) providing a hearing impaired subject;

c) surgically implanting said transducer in the middle ear of said subject and said receiving coil external to said middle ear, said surgical implanting comprising creating a channel in the temporal bone of said subject and inserting said transducer through said channel into the middle ear; and d) conducting current from said receiving coil to said implanted transducer so as to cause said housing to vibrate.

2. The method of claim 1 wherein said implanting further comprises securing said housing substantially exclusively to an ossicle in said middle ear.

3. The method of claim 2 wherein said securing comprises attaching the housing to the long process of the incus.

4. The method of claim 1 wherein said implanting further comprises securing said housing between the incus and malleus of said middle ear.

5. The method of claim 1 wherein said implanting further comprises shaping a concave portion of the mastoid and subcutaneously placing said receiving coil in said concave portion.

6. The method of claim 5 wherein said implanting further comprises placing said leads in said channel.

7. A method of improving hearing in a subject, comprising the steps of:

a) providing a device comprising:

i) an electromagnetic transducer comprising a first coil and a magnet attached to a housing, such that said first coil is attached more rigidly to said housing than said magnet, said magnet producing a first magnetic field and said first coil producing a second magnetic field, said first and second magnetic fields interacting to cause vibrations of said housing, ii) a sound transducer, said sound transducer being positioned on the skull, iii) a receiving coil, said receiving coil adapted to receive a signal from said sound transducer, and iv) leads connecting, and allowing for current between, said electromagnetic transducer and said receiving coil;

b) providing a hearing impaired subject;

c) surgically implanting said electromagnetic transducer in the middle ear of said subject and said receiving coil external to said middle ear, said surgical implanting comprising creating a channel in the temporal bone of said subject and inserting said transducer through said channel into the middle ear;

d) transmitting a signal from said sound transducer to said receiving coil;

e) conducting current from said receiving coil to said implanted electromagnetic transducer, thereby causing vibrations of said electromagnetic transducer; and f) conducting said vibrations to the oval window of the ear.

8. The method of claim 7 wherein said implanting further comprises securing said housing substantially exclusively to an ossicle in said middle ear.

9. The method of claim 8 wherein said securing comprises attaching the housing to the long process of the incus.

10. The method of claim 7 wherein said implanting further comprises securing said housing between the incus and malleus of said middle ear.

11. The method of claim 7 wherein said implanting further comprises shaping a concave portion of the mastoid and subcutaneously placing said receiving coil in said concave portion.

12. The method of claim 11 wherein said implanting further comprises placing said leads in said channel.

* * * * *